US006041528A

United States Patent [19]

Broach

[11] Patent Number: 6,041,528

[45] Date of Patent: Mar. 28, 2000

[54] HIGH PERFORMANCE EJECTOR SCRAPER

[75] Inventor: Keith A. Broach, Beebe, Ark.

[73] Assignee: Harvey Mfg. Corp., Beebe, Ark.

[21] Appl. No.: 09/162,482

[22] Filed: Sep. 23, 1998

[51] Int. Cl.[7] ..... E02F 3/65

[52] U.S. Cl. ..... 37/431; 37/426; 37/416

[58] Field of Search ..... 37/416, 417, 418, 37/419, 426, 427, 431, 304, 901

[56] References Cited

U.S. PATENT DOCUMENTS

| | | | |
|---|---|---|---|
| D. 314,935 | 2/1991 | Collins | D12/160 |
| 326,284 | 9/1885 | Forbes . | |
| 1,149,153 | 8/1915 | Schleicher . | |
| 2,239,849 | 4/1941 | Judd | 280/81 |
| 2,271,790 | 2/1942 | Allin | 37/416 |
| 2,534,256 | 12/1950 | Fischer | 280/80 |
| 2,609,622 | 9/1952 | Murray | 37/426 |
| 2,669,043 | 2/1954 | Reischl | 37/426 |
| 2,677,202 | 5/1954 | Gustafson | 37/426 |
| 2,988,832 | 6/1961 | Hancock et al. | 37/129 |
| 3,274,711 | 9/1966 | Johnson et al. | 37/129 |
| 3,303,587 | 2/1967 | Rockwell | 37/8 |
| 3,431,663 | 3/1969 | Eiger | 37/129 |
| 3,452,462 | 7/1969 | Martin | 37/431 |
| 3,462,860 | 8/1969 | Hermiz et al. | 37/129 |
| 3,465,458 | 9/1969 | Wagner | 37/129 |
| 3,479,756 | 11/1969 | Martin | 37/129 |
| 3,479,758 | 11/1969 | Johnson et al. | 37/129 |
| 3,483,640 | 12/1969 | Anderson et al. | 37/426 |
| 3,483,644 | 12/1969 | Potgieter | 37/127 |
| 3,486,251 | 12/1969 | Carston | 37/4 |
| 3,488,870 | 1/1970 | Holets et al. | 37/129 |
| 3,584,403 | 6/1971 | Copeland | 37/8 |
| 3,596,382 | 8/1971 | Jan Jocher | 37/426 X |
| 3,596,383 | 8/1971 | Bispo et al. | 37/8 |
| 3,660,914 | 5/1972 | Bechman et al. | 37/129 |
| 3,693,273 | 9/1972 | Sullivan | 37/129 |
| 3,707,048 | 12/1972 | Peterson | 37/426 |
| 3,739,504 | 6/1973 | Miller | 37/124 |
| 3,742,628 | 7/1973 | Walser et al. | 37/124 |
| 3,931,687 | 1/1976 | Johns, Jr. | 37/8 |
| 3,934,360 | 1/1976 | Hyler | 37/8 |
| 3,952,432 | 4/1976 | Boersma | 37/126 |
| 3,995,383 | 12/1976 | Breitenstein et al. | 37/126 |
| 4,041,625 | 8/1977 | Fisher et al. | 37/126 |
| 4,109,400 | 8/1978 | Richardson | 37/126 |
| 4,133,122 | 1/1979 | Girard et al. | 37/126 |
| 4,308,677 | 1/1982 | Behm | 37/126 |
| 4,389,800 | 6/1983 | Goby | 37/124 |
| 4,871,025 | 10/1989 | Mayfield et al. | 172/4.5 |
| 5,482,326 | 1/1996 | Levi | 280/682 |
| 5,839,212 | 11/1998 | Brinker | 37/416 |

OTHER PUBLICATIONS

LCE Series Spec. Sheet Harvey Manufacturing Co.

*Primary Examiner*—Victor Batson
*Attorney, Agent, or Firm*—Stephen D. Carver

[57] ABSTRACT

An ejector-scraper comprising a hopper having an ejector assembly mounted therein for selectively discharging dirt and debris from the interior of the hopper. The ejector is displaced longitudinally through the hopper through a retractable scissors-actuator movably mounted to the rear frame of the ejector-scraper. Suitable links rotatably and slidably couple the actuator to the ejector. The scissor actuator comprises two brackets pivotally coupled at their center points to form an X-shaped lever system. The carriage further comprises pivoting wheel means for selectively raising or lowering the ejector-scraper. The wheel means are attached to the back frame and preferably comprise two pairs of offset, and staggered tires mounted to a rocker in turn pivoted to a V-shaped link. The link is in turn pivoted to a carrier pivotally connected to, and projecting rearwardly from, the scraper. The latter construction enables the wheel means to pivot in response to irregularities in the ground's surface.

22 Claims, 9 Drawing Sheets

HIGH PERFORMANCE EJECTOR SCRAPER

BACKGROUND OF THE INVENTION

I. Field of the Invention

The present invention relates generally to earth working machines including land levelers, ejectors and scrapers. More particularly, the present invention relates to hopper-equipped, scraper ejectors typical of the type classified in United States Patent Class 37, Subclasses 411, 412, 416, 421, and 431.

II. Description of the Prior Art

In the earth working arts, the well-recognized need for efficient leveling equipment persists. A number of scrapers and ejectors, some of who are equipped with an internal hopper, have evolved. Modern farming operations are streamlined by leveling fields or tracts of land prior to planting or other fieldwork. In fish farming for example, large, uniformly smooth ponds can be excavated and formed by modern ejector-scrapers. Earth removed from the pond center is transported to and dumped upon the pond circumference to form a secure periphery. It is well known that efficiency is enhanced by using scraper machines that can not only dig out earth to be moved, but can temporarily store the material for transportation to the appropriate site for subsequent ejection.

In the prior art, a number of carriage-mounted devices have been proposed to level land. However, in relatively smaller scale operations it is important that high efficiency be achieved. A useable, desirable device would thus combine the operations of cutting or scraping with the operations of transporting and ejecting the earth. A single operator can thus level or dig over certain areas of land, and then transport the dirt for relocation to an adjacent area about the field or pond in a simple repetitive operation. Known ejector-scraper machines typically comprise a wheeled carriage adapted to be towed by a tractor or the like. A large hopper is formed near the center of the apparatus. The hopper is formed between a bottom wall, a portion of the scraper, laterally spaced apart sidewalls, and a rear wall. The hopper receives and temporarily stores earth and debris that enters the hopper through an exposed, front orifice as the machine is drawn across a site by a tractor. A lower, ground-engaging scraper attacks the ground at a predetermined angle that is preferably adjustable. After dirt and debris accumulate and fill the hopper, the hopper must be emptied. Prior to discharge, the user transports the ejector scraper to a portion of the land or field under treatment where a low spot is to be filled, or where an earthen formation is to be established.

Designers of prior ejector-scraper machines have sought to increase the size of the load which could be carried to maximize volumetric efficiency. One of the problems with increasing the capacity of an excavating machine resides in the controlled unloading. Assuming a full hopper of very large capacity, it is readily apparent that such a hopper can be dumped to release the load in one location. It is also apparent that pushing the load out of the hopper at a controlled rate to spread it over an area would require extreme forces. The art has developed to produce a hopper of large capacity, and incorporating an effective means to unload the hopper at a controlled rate.

Discharging the hopper is accomplished either by gravity or more generally by a vertically disposed, dozer-type ejector blade. The blade may be positioned near a rear wall of the hopper, and in some devices, the blade itself forms the rear wall. Typically, the blade is moveable forwardly across the hopper bottom between the sidewalls by hydraulic cylinders. The ram is connected by suitable linkage between the ejector blade and some sturdy fixed point on the scraper chassis. The ram or rams extend at uniform speed and with uniform force to effect full forward travel of the ejector blade. It has been found when moving certain types of earth, such as gumbo and sticky material, it is difficult to prevent the blade from binding as it is deflected angularly. The effect of the ejector plate is often to compact the soil into a tight mass, which becomes firmly stuck to the sides of the hopper. This compaction can cause distortion in the dimensions of the hopper, and irregularities in the displacement of the ejector, all of which decrease efficiency as maintenance chores are increased.

Many types of alignment systems have been proposed for securing the blade. In some designs, guides projecting laterally from the ejector plate are slidably received within suitable slots that are formed in or secured upon the sidewalls. Examples of the foregoing design are seen in U.S. Pat. Nos. 4,308,677, 4,041,625, and 4,133,122. Other designs, such as that seen in U.S. Pat. No. 3,952,432 use guide rollers within the carriage that are interconnected with the ejector blade.

Know prior art designs have attempted to further stabilize the ejector blade with multiple, extendable hydraulic rams. A variety of attachment points between the rams, the carriage and the ejector blade have been employed. The rams apply pressure on different points of the ejector in order to compensate for the varying forces needed to empty the hopper. These multi-ram systems require the use of complex hydraulic flow divider/combiner mechanisms to provide uniform extension and retraction of the rams. Obviously, such mechanisms are more complex and more costly than a single ram system. Still others have adapted a single ram attached to the lower portion of the ejector and stabilizer bars designed to counteract side thrust forces encountered by the ejector as it moves forward to empty the hopper. These mechanisms add to the overall weight of the scrapper, increase the overall number of parts required for operation and owing to the greater complexity, increase the overall cost of operation.

Another problem encountered with prior art earth movers is maintaining a level grade both in removing earth and in transporting the load to a dump site. Machines of this type typically have rear wheels adapted to raise or lower the hopper is response to hydraulic actuators to effect the desired grade level for earth removal. These actuators are also used to elevate the hopper to a higher level to transport the filled hopper to a dump site. These prior art wheel arrangements have a tendency to raise or lower in relation to the desired cutting grade when traveling over uneven terrain. When these machines are raise to the height required for transportation there is a tendency for the wheels to bounce due to the flattening of the tires as they travel over ground irregularities. This bouncing action results in increased stress on the carriage and a decrease in the stability of the machine as it transports the load to a dump site. The previous practice has been to "pre-level" the area with a bulldozer before the final precision work is attempted to avoid the variations in grade. This practice has necessitated the duplication of work involved to effect the desired leveling.

Previous wheel assemblies have attempted to provide a mechanism to allow the chassis to remain stable while the wheels respond to irregularities in the terrain. The range of motion in these previous assemblies is very limited. The wheels are generally connected by a chain or gear mechanism such that the wheels do not operate independently. This limits the variations in terrain that these assemblies are able to accommodate. Thus, such devices are more effective on ground that has been previously leveled. The closest prior art wheel system known to applicant is that of U.S. Pat. No. 5,482,326 that employs a rocker arm pivoted at its midpoint, that supports a pair of spaced apart wheels at its ends.

SUMMARY OF THE INVENTION

This invention provides a high performance ejector scraper that is directed to overcoming the problems as set forth above. According to the present invention an extendable/retractable ejector system activated by a single hydraulic actuator is provided for emptying a hopper filed with dirt and debris. The preferred actuator comprises an X-shaped scissor system that is properly interlinked between the carriage and the blade to equalize the pressure exerted on each side of the ejector during hopper unloading.

This invention further provides a pivoting wheel system which allows the scraper to level terrain within closer tolerances than other machines. The pivoting wheel assembly allows the scraper to be towed at a higher rate of speed over uneven terrain.

Thus a basic object is to provide an ejector-scraper that displaces an ejector with a single actuator.

A related object is to is to provide an ejector-scraper that has a self aligning actuator system for selectively deploying or retracting an ejector blade.

Another object is to is to provide an ejector-scraper that evenly distributes the force on the ejector without the use of complex hydraulic dividers.

A related object is to provide an ejector-scraper that has low maintenance and operating costs.

Another important object is to provide an ejector-scraper that can discharge loads of earth without binding the ejector.

Another important object is to provide a device that combines the operations of cutting or scraping with the operations of transporting and ejecting the earth.

Another basic object is to provide an ejector-scraper that is capable of being towed at a high rate of speed to reduce the time required for job completion. Another important object is to is to provide an ejector-scraper of the character described that has independently pivoting wheels that facilitate close tolerance grading.

A further object is to provide an ejector-scraper that has pivoting wheel system that reduces the bouncing action during transport.

A related object is to reduce the stress experienced by the ejector blade system in an ejector scraper.

A still further object is to increase the stability of an ejector scraper machine of the character described.

Yet another object is to is to provide an ejector-scraper of the character described having a high capacity hopper.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
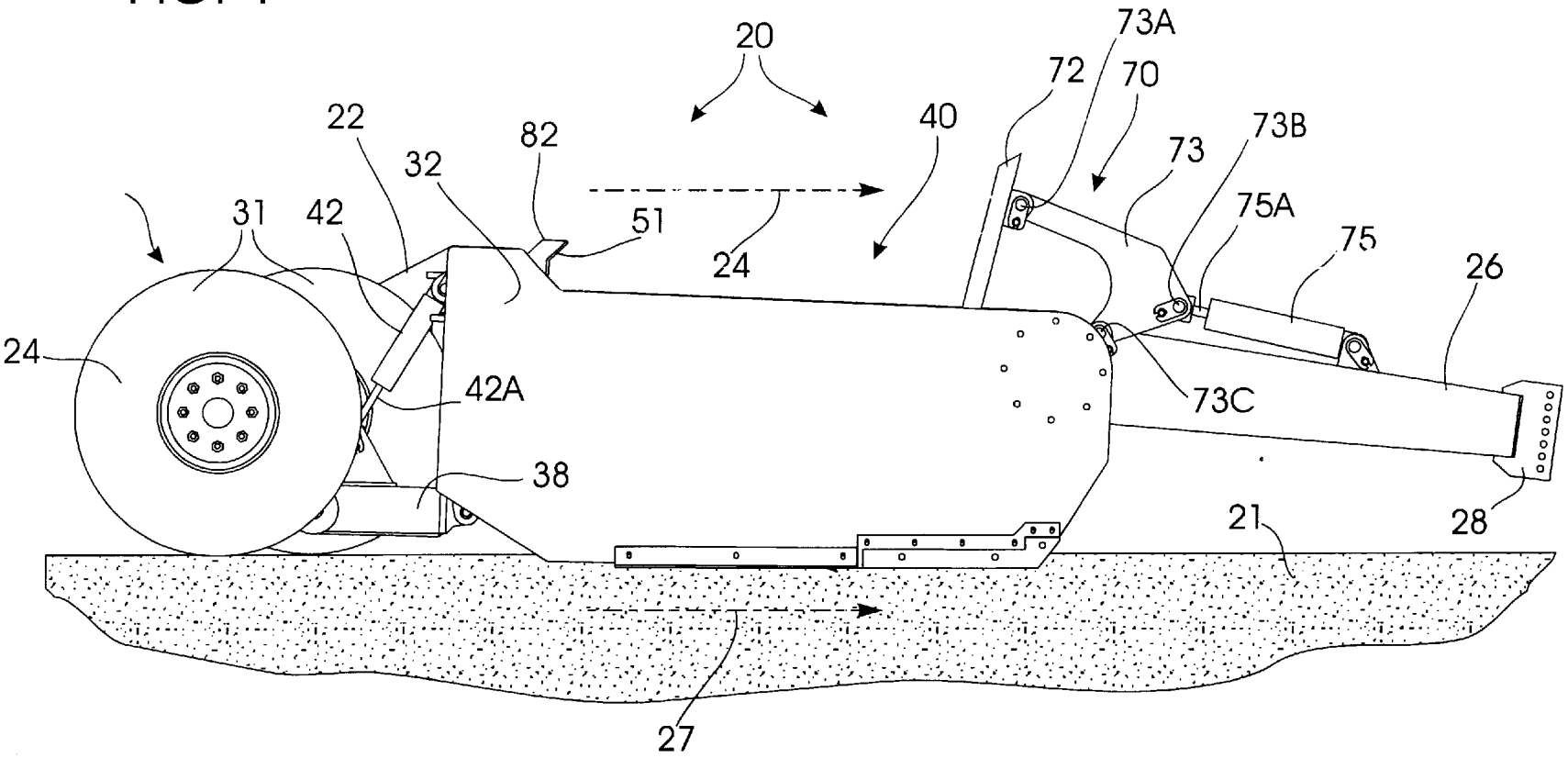
FIG. 1 is a side elevational view of my High Performance Ejector Scraper, with the hopper closed and the gate open.

Turning now to the drawings, my high performance ejector-scraper 20 (FIGS. 1–3) comprises a rigid carriage 25 that is suspended by a wheeled system 30. The ejector scraper 20 is adapted to be connected to a tow vehicle (not shown) by coupler 28 and neck 26, for movement in the direction indicated by arrows 24, 27 (FIG. 1). A hopper 40 is disposed within carriage 25. The hopper forms a storage interior that is in communication with a lower, normally blocked orifice 50. A scraper 60 (FIG. 5) is angularly mounted adjacent orifice 50 (FIG. 6) to engage earth and load hopper 40. Gate 70 forms the front of hopper 40 and is selectively raised to expose orifice 50 to allow the loading or discharge of hopper 40. An ejector 80 forms the back of hopper 40 and is adapted to be extended or retracted within hopper 40 by scissor means 90 to discharge earth at a dump site. Carriage 25 (FIG. 2) is composed of a frame 22 and upper support bar 36 and lower support bar 37 disposed rearwardly in carriage 25. The front of the carriage comprises a rigid cross bar 41 upwardly disposed and adapted to connect with neck 26.

Hopper 40 is disposed within carriage 25, defined between vertical side walls 32 that are mounted forwardly to front cross bar 41 and secured rearwardly to cross bars 36, 37. The bottom of hopper 40 provides a floor 41B (FIG. 6) that is aligned generally with the scraper 60. An input/output orifice 50 traverses the width of hopper 40 at the front of the device. Scraper 60 (FIG. 2) is disposed rearwardly and adjacent to orifice 50 and is adapted to fill hopper 40 with dirt and debris 23 (FIG. 3) as ejector-scraper 20 moves along the earth 21. The rear of hopper 40 is defined by a displaceable/retractable ejector 80. The forward interior limit of hopper 40 is defined by a movable gate 70.

Gate 70 (FIG. 5) comprises foot 69 traversing the width of hopper 40 and adapted to mate along foot 69 rearward end with scraper 60 when gate 70 is deployed in the closed position thereby sealing hopper 40. Two similar legs 71 are mounted at the lower end to foot 69 adjacent side walls 32. Leg 71 is rotatably attached at the upper end to side walls 32 by pin 71A. Wall 72 comprises a generally vertical, flat plate traversing the width of hopper 40. The lower end of wall 72 is hingedly attached to the forward edge of foot 69 at hinge 72A. The upper end of wall 72 is rotatably attached to crank 73 along the rearward end point of crank 73 at attachment point 73A. The forward end of crank 73 is rotatably attached to bar 41 at 73C. Cylinder 75 is pivotally attached at its forward end to neck 26 while ram 75A is pivotally coupled to crank 73 at intermediate pivot point 73B.

Figure 4:
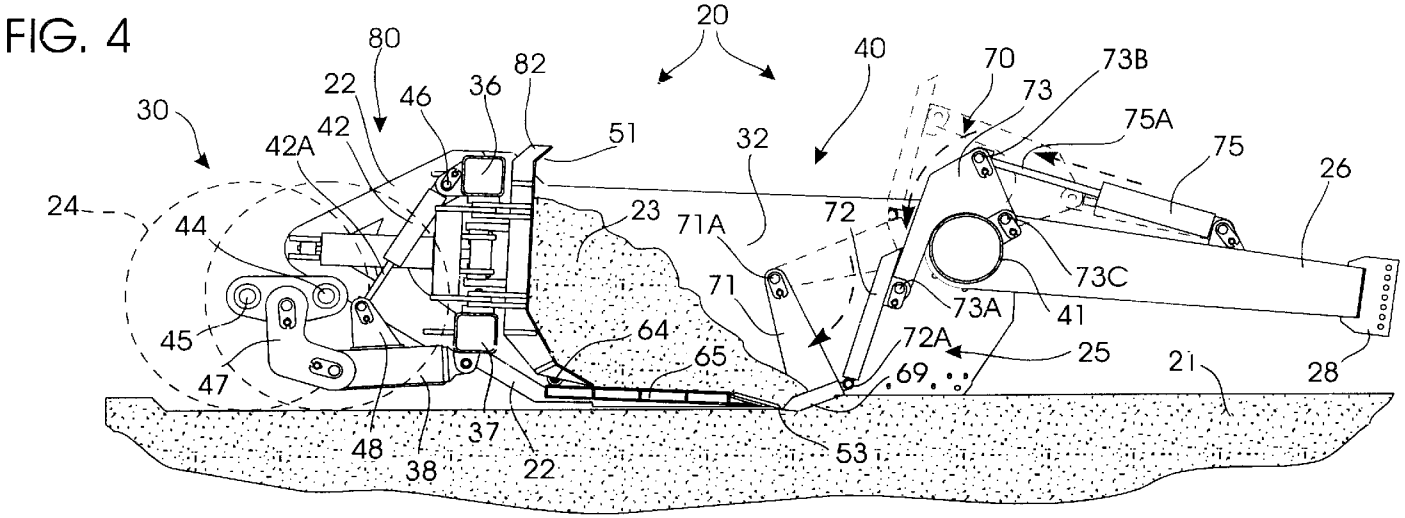
FIG. 4 is a view similar to FIGS. 2–3, but showing the interior of the hopper with the gate closing.

Scraper 60 comprises an angular blade 53 for engaging the earth 21. The rear of blade 53 is supported and contained by frame 22. Spaced apart rails 65 securely attached to the floor of hopper 40 and parallel to sides 32 further support and contain blade 53. Rails 65 engage flanged guide wheels 64 (FIGS. 4, 5) that allow for the longitudinal displacement and withdrawal of ejector 80 and preventing the lateral movement of ejector 80.

Figure 7:
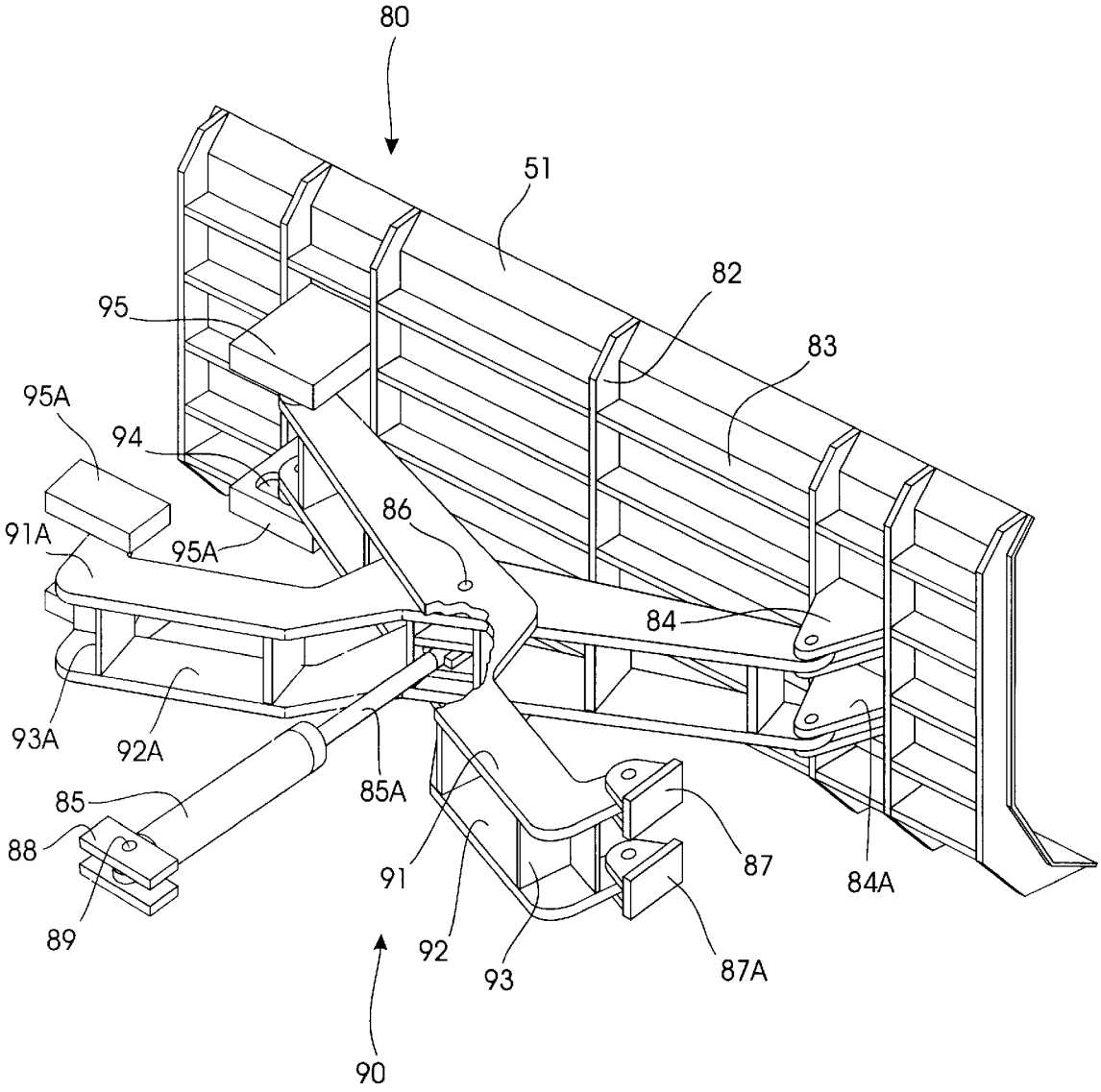
FIG. 7 is an enlarged, fragmentary isomeric view of the preferred blade actuator.

Ejector 80 defines the rear of hopper 40. Ejector 80 (FIG. 7) generally comprises a dozer type front plate 51 reinforced by vertical brace 82 and horizontal brace 83. Scissor means 90 longitudinally deploy and retract ejector 80. Scissor means 90 generally comprise levers 91, 92, 91A, 92A (FIG. 7) that are spaced apart and supported by spacers 93, 93A. Levers 91, 92, 91A, 92A are pivotally connected at intermediate pivot point 86 to form an X-shaped extendable/retractable activator to deploy and retract ejector 80. Disposed at one end of ejector 80 are upper and lower end plates 95, 95A. Similarly mounted at the other end of ejector 80 are upper and lower clevis brackets 87, 87A. Rotatably and slidably contained within follower slots 94 (FIG. 7), 94A (FIG. 9) are ejector ends of upper and lower scissor plates 91, 92 (FIG. 7). Clevis brackets 84, 84A rotatably contain ejector ends of upper and lower scissor plates 91A, 92A. Rearward ends of scissor means 90 are rotatably and slidably attached to frame 22. Cylinder 85 is pivotally attached to frame 22 at connecting plate 88 (FIG. 7) by connecting pin 89. Ram 85A is connected to scissor means 90 at pivot point 86 such that extension or retraction of ram 85A activates scissor means 90 to longitudinally deploy or retract ejector 80.

Figure 6:
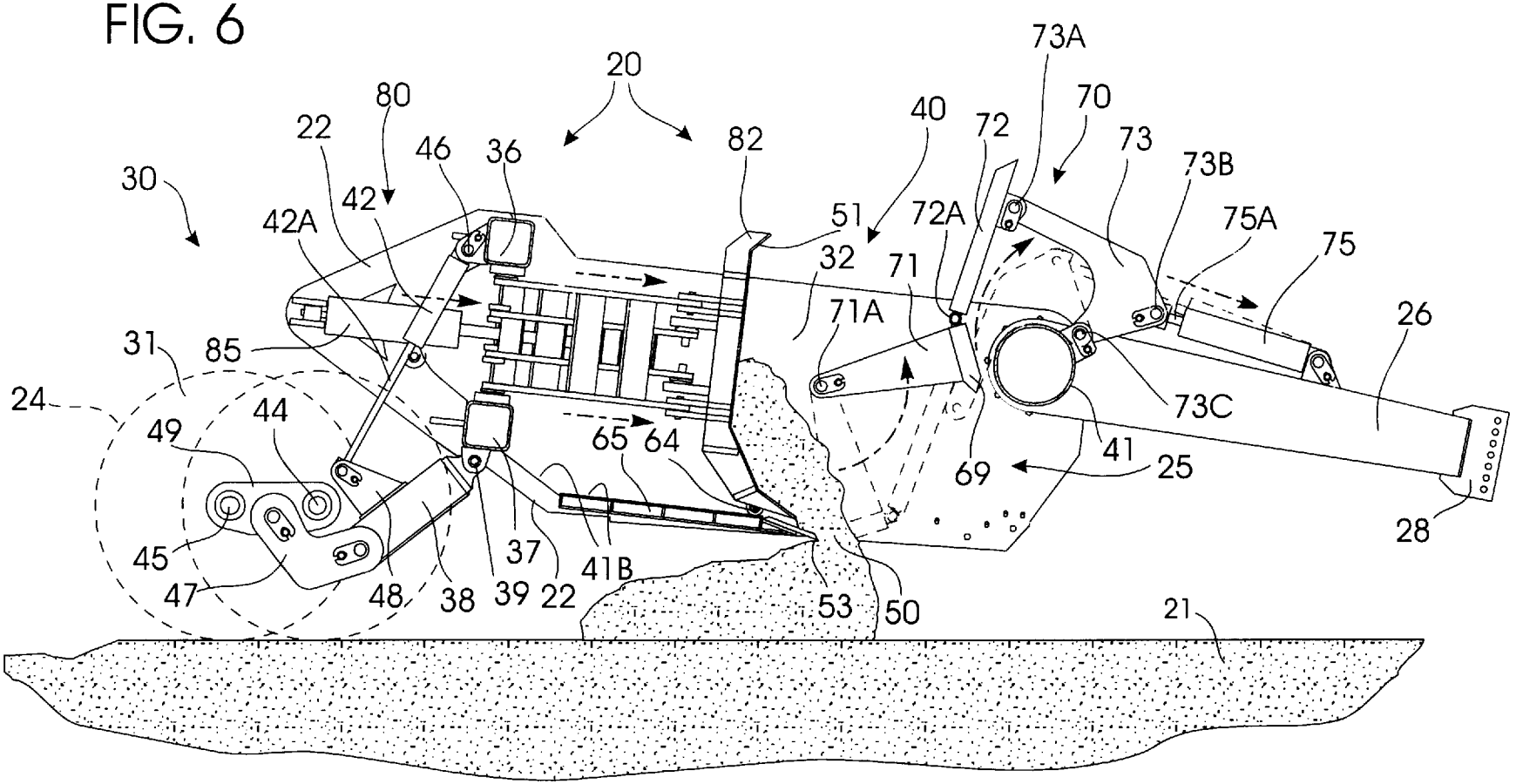
FIG. 6 is a view similar to FIGS. 2–6, but showing the gate open and the blade deployed.
Figure 10:
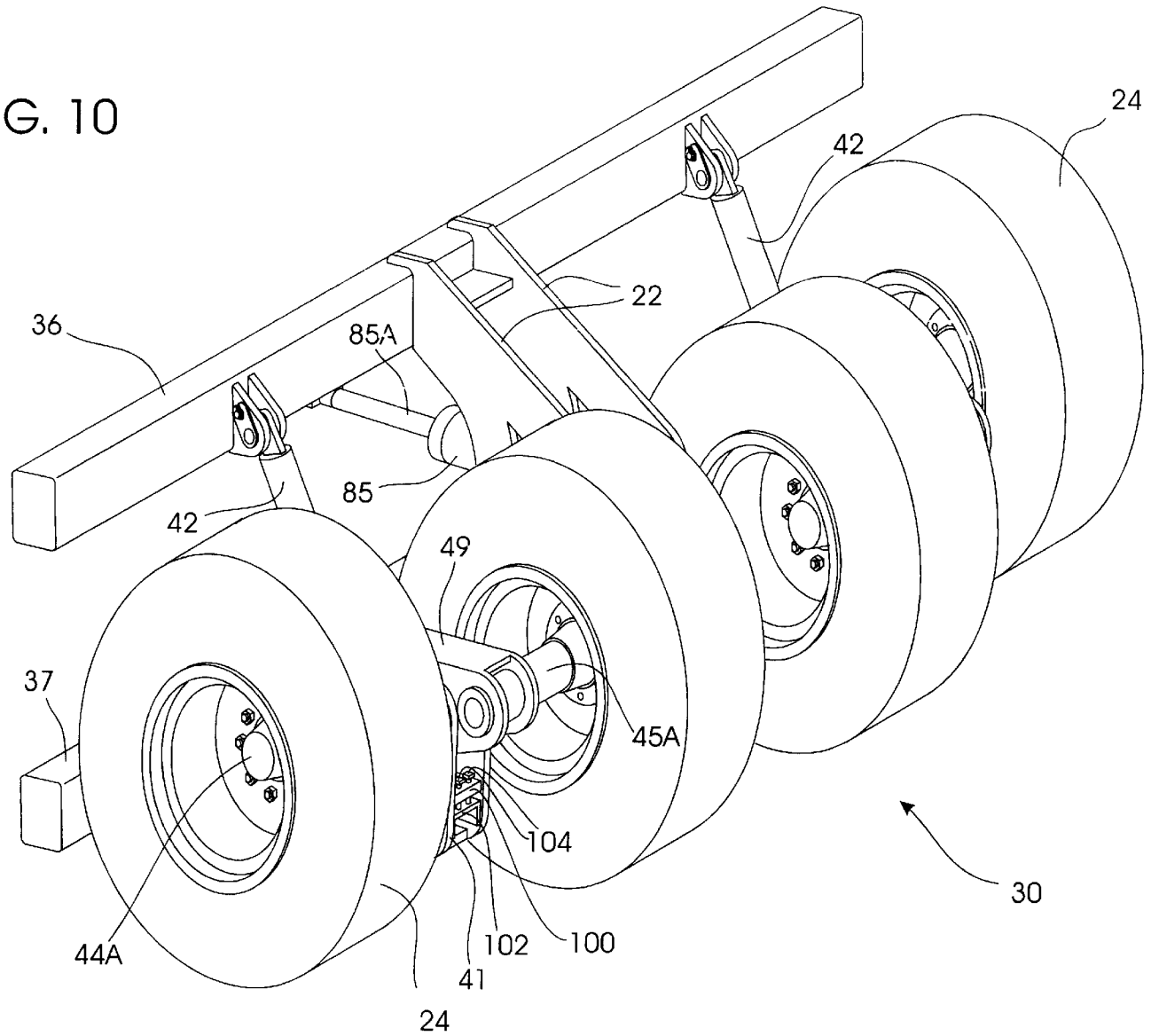
FIG. 10 is an enlarged, fragmentary isometric view of the preferred wheel system; and, FIG. 11 is an enlarged, fragmentary isometric view of the wheel system with the tires removed for clarity.
Figure 11:
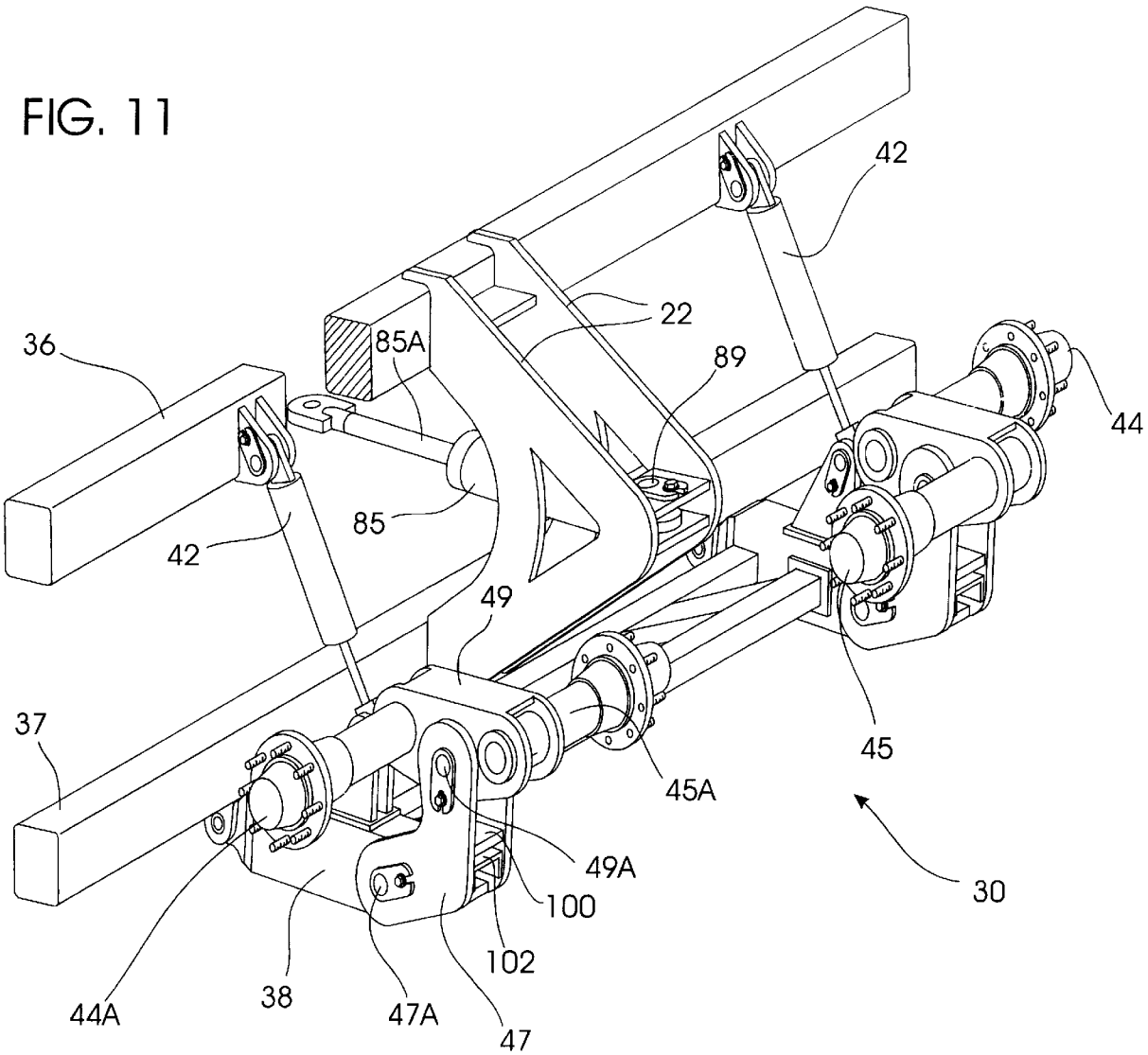

Wheel system 30 (FIGS. 10, 11) is movably coupled to carriage 25 at cross bars 36, 37. Wheel assembly 30 generally comprises two pair of tires 31 mounted to offset and staggered axles 44, 44A, 45, 45A that transversely project away from rocker 49 in opposite directions. Rocker 49 is freely, pivotally coupled to one end of a rigid, somewhat V-shaped, adjustment link 47 by pivot pin 49A (FIG. 11). Carrier 38 is rotatably attached to bar 37 by forward connecting pin 39 (FIG. 6). Carrier cylinder 42 is pivotally connected to upper cross bar 36 (FIG. 6) at a pivot 46. Ram 42A is pivotally attached to carrier 38 at carrier ears 48.

Link 47 is pivotally connected at its other end to carrier 38 by pivot pin 47A (FIG. 11), but it is not free to pivot during machine operation. A transverse inner plate 100 (FIG. 11) extends between opposite sides of the link 47. Link plate is vertically spaced apart from the rearwardly projecting portion 102 of carrier 38 (FIGS. 10, 11). Adjustment bolts 104 that penetrate plate 100 forcibly engage plate 102 to maintain proper spacing. In this manner the wheels supported by rocker 49 can be adjusted slightly as desired to accommodate rough and uneven ground. The pairs of wheels on opposite sides are thus adjustable independently from one another.

Operation

Figure 2:
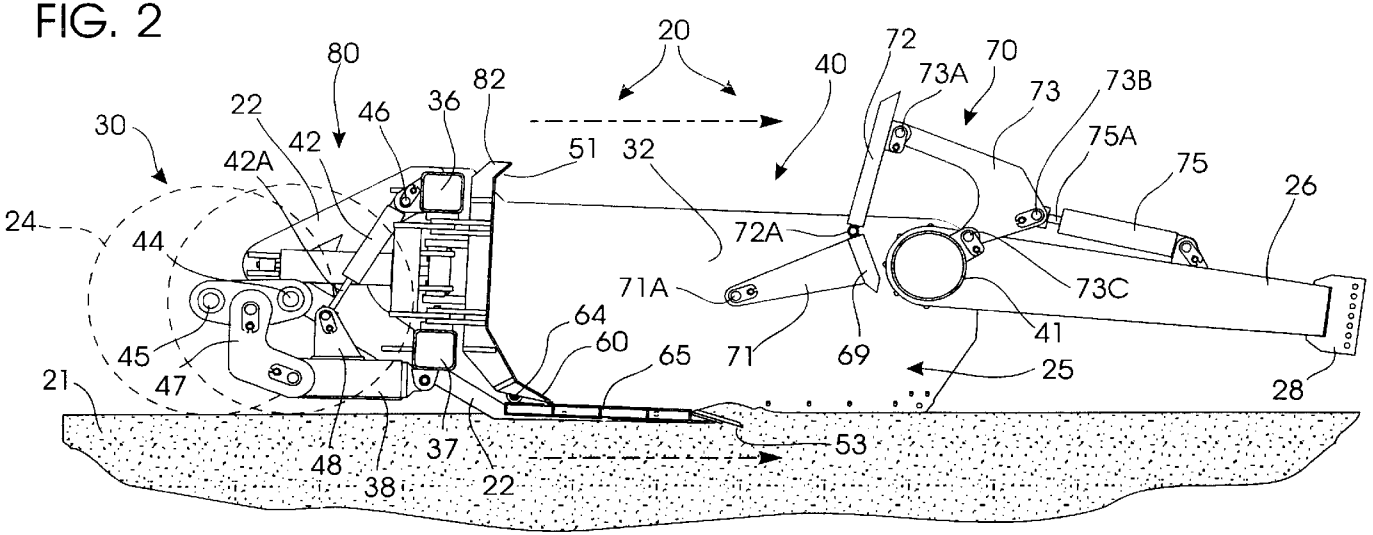
FIG. 2 is a fragmentary, longitudinal sectional view showing the interior of the hopper and the scraper just prior to deployment.
Figure 3:
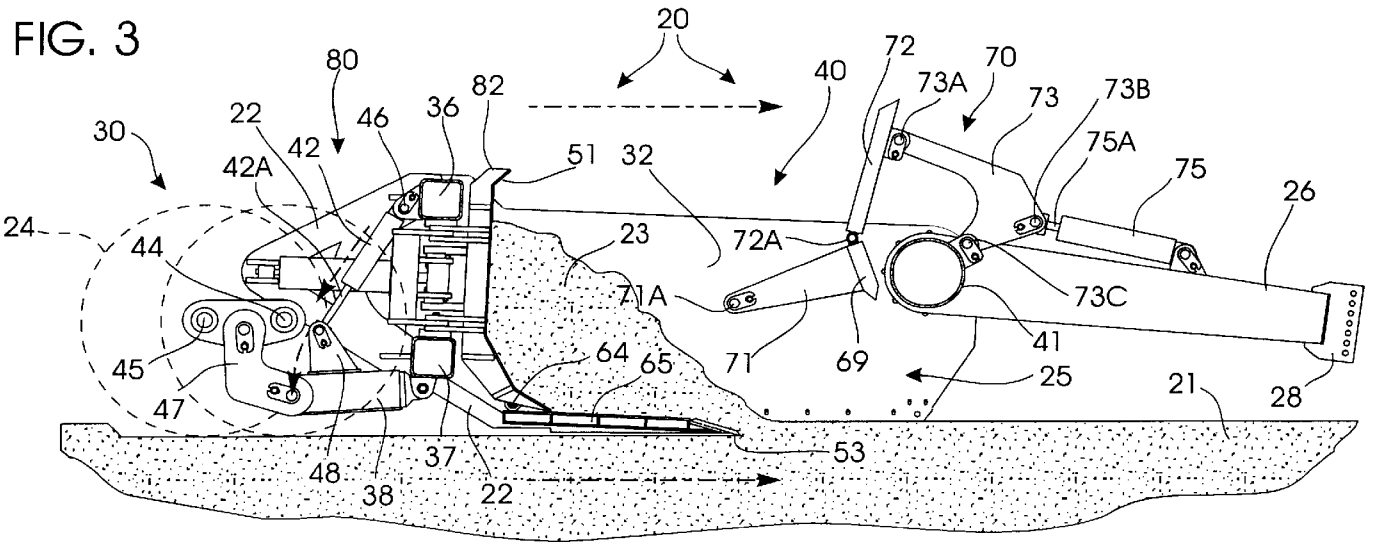
FIG. 3 is a view similar to FIG. 2, but showing the interior of the hopper and the scraper after machine deployment.
Figure 5:
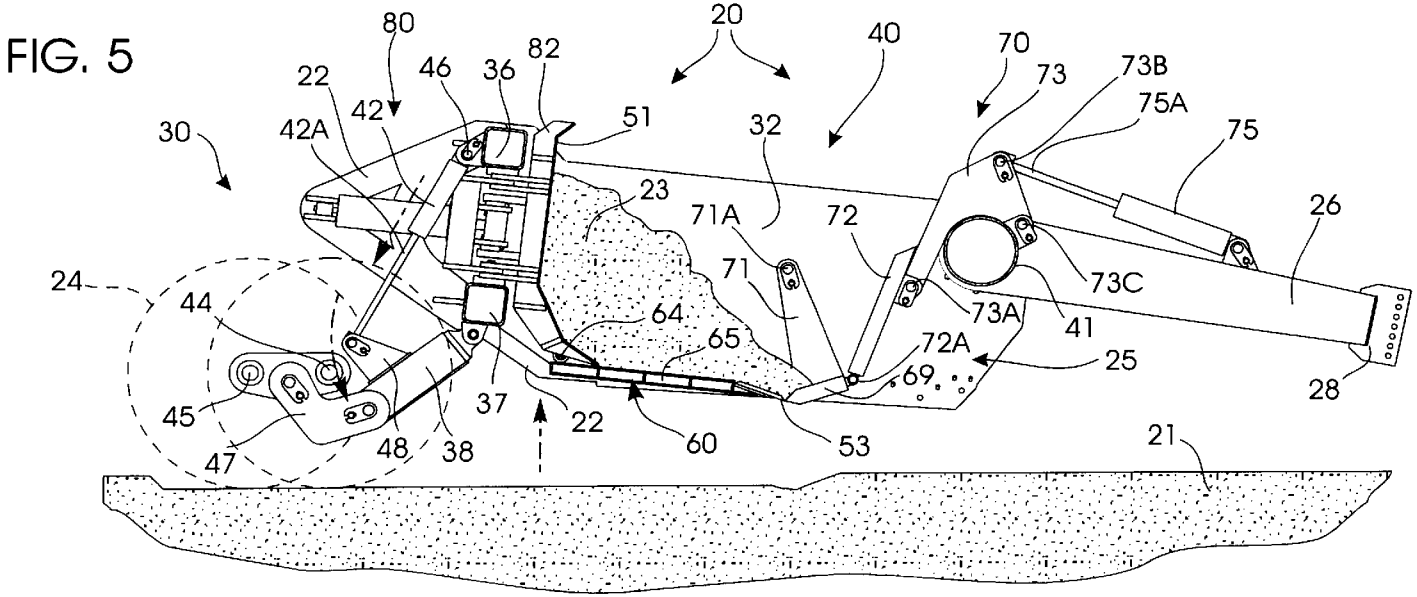
FIG. 5 is a view similar to FIGS. 2–4, but showing the machine elevated for transportation of the load to a dumping location.

Cylinder 42 is activated to retract ram 42A raising wheel assembly 30 to allow ejector-scraper 20 to engage the earth 21 (FIG. 2). Gate 70 is raised exposing input/output orifice 50 for the intake of dirt and debris from scraper 60. As tow vehicle (not shown) pulls ejector-scraper 20 over the earth, scraper 60 loads dirt and debris 23 through the input/output orifice 50 into hopper 40 (FIG. 3). When the desired load has been collected, gate 70 is lowered to close orifice 50 (FIG. 4) thereby containing dirt and debris 23 in hopper 40 for transportation to a dump site. Cylinder 42 is activated to extend ram 42A raising wheel assembly 30 (FIG. 5). The ejector-scraper 20 is then moved to a dump site. Gate 70 is raised exposing orifice 50 to allow for the removal of dirt and debris 23 by the longitudinal displacement of ejector 80. (FIG. 6).

Figure 8:
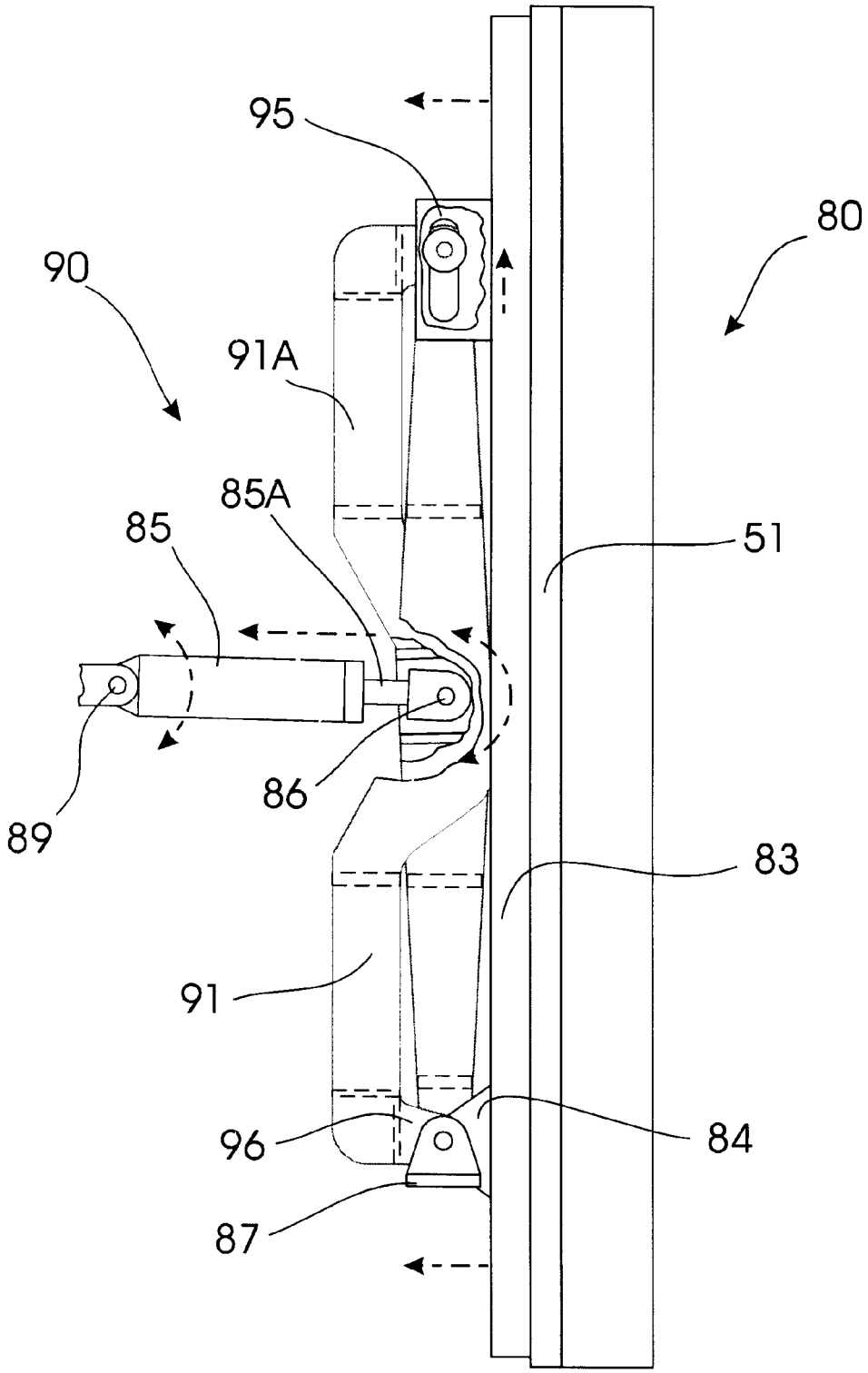
FIG. 8 is an enlarged top plan view of the actuator in a retracted state.
Figure 9:
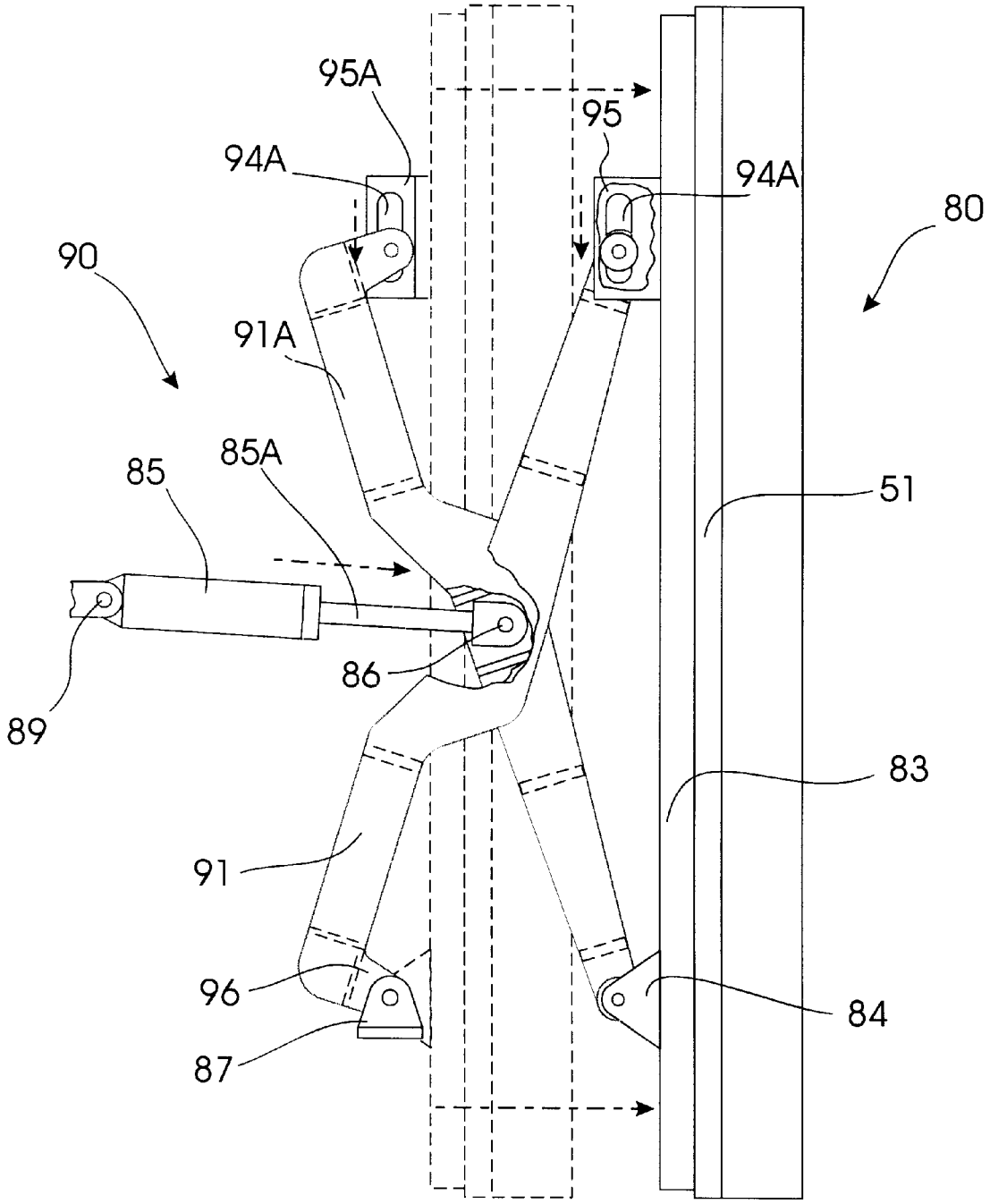
FIG. 9 is an enlarged, top plan view of the deployed actuator.

Ejector 80 is displaced by the extension of ram 85 through the scissor means 90 at pivot point 86 (FIGS. 8, 9). As ram 85 extends, scissor means 90 expand pushing ejector 80 through the interior of hopper 40. Ejector 80 is contained by walls 32 on each side and travels along the floor of hopper 40 on flanged wheels that engage guide rails 65 FIG. 6).

As the ejector-scraper 20 is towed along the earth wheel assembly 30 pivot in response to variations in terrain topography (FIGS. 10, 11). When tires 31 engage+an irregularity in the ground's surface, they are able to accommodate the change by pivoting on rocker 49 thereby allowing the ejector-scraper 20 to remain level and stable as it moves about the work site. Prior to operation, bolts 104 (FIG. 11) can be adjusted to space the left side wheels or the right side wheels higher or lower than the other pair of wheels, accommodating sloped ground. In this manner the wheels supported by rocker 49 accommodate rough and uneven ground.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A high performance ejector-scraper comprising;

a rigid carriage adapted to be displaced over ground to be worked;

a wheel system for suspending said carriage;

a hopper disposed within said carriage having a storage interior and an input-output aperture that can be opened or closed;

a scraper exposed when said aperture is open for selectively engaging earth;

a retractable gate for opening said hopper to expose said aperture for filling said interior with earth dislodged by said scraper;

an ejector for selectively emptying said hopper through said aperture;

actuating means for operating said ejector, said actuator means comprising scissor means for pushing or pulling said ejector, and cylinder means for deflecting or retracting said scissor means, said scissor means comprising:

a first rigid, elongated lever comprising a rear end pivotally coupled to said carriage, a middle, and a front end coupled to an end of said ejector; and, a second rigid, elongated lever comprising a rear end pivotally coupled to said carriage, a middle, and a front end coupled to said ejector.

2. The scraper as defined in claim 1 wherein said first and second levers intersect one another to form an X-shaped profile.

3. The scraper as defined in claim 2 further comprising pivot means extending through the middle of both levers for interconnecting with said cylinder means.

4. The scraper as defined in claim 2 wherein at least one end of each of said elongated levers comprises a follower received within a follower slot for dimensionally compensating as said scissor means retracts or deploys.

5. The scraper as defined in claim 1 wherein said wheel system comprises two pairs of spaced apart and offset wheels that engage the ground and suspension means for elevating or lowering said carriage by deflecting said wheels.

6. The scraper as defined in claim 1 wherein:

said carriage comprises a rigid, box-like frame having a floor, a front adapted to be coupled to a tow vehicle, a rear supported by said wheel system, and a pair of opposed sides, said floor, rear and sides defining said interior;

said scraper is transversely disposed across the input-output aperture and extends generally between said sides; and, said ejector comprises a rigid, generally rectangular plate extending transversely within said hopper generally between said sides and displaceable between said front and said rear by said actuating means.

7. The scraper as defined in claim 6 wherein said wheel system comprises two pairs of spaced apart and offset wheels that engage the ground and suspension means for elevating or lowering said carriage by deflecting said wheels.

8. The scraper as defined in claim 6 wherein said scissor means comprises:

a first rigid, elongated lever comprising a rear end pivotally coupled to said carriage, a middle, and a front end coupled to an end of said ejector;

a second rigid, elongated lever comprising a rear end pivotally coupled to said carriage, a middle, and a front end coupled to said ejector; and, wherein said first and second levers intersect one another to form an X-shaped profile.

9. The scraper as defined in claim 8 further comprising pivot means extending through the middle of both levers for interconnecting with said cylinder means.

10. The scraper as defined in claim 9 wherein at least one end of each of said elongated levers comprises a follower received within a follower slot for dimensionally compensating as said scissor means retracts or deploys.

11. A high performance ejector-scraper comprising;

a wheeled, movable carriage adapted to towed by a vehicle;

a hopper disposed within said carriage, said hopper having a front, a back, a pair of opposed sides separated by the width of said hopper, and an interior;

an aperture defined in the hopper for admitting or discharging earth;

a gate for opening or closing said aperture;

means for opening or closing said gate;

a scraper mounted beneath the hopper for engaging earth when the gate is opened;

an ejector for discharging the contents of said hopper through said aperture to empty said scraper;

scissor means for deploying and withdrawing said ejector; and, wherein said gate comprises:

a leg pivotally mounted within said interior;

a foot controlled by said leg for abutting the scraper when the gate is closed;

a movable door traversing the width of said hopper, said door comprising a lower end pivoted to said foot, and an upper end; and, a crank pivotally coupled to said upper end of said door, said crank pivotally coupled to said means for opening or closing said gate.

12. The scraper as defined in claim 11 wherein said wheeled, movable carriage comprises two pairs of spaced apart and offset wheels that engage the ground and suspension means for elevating or lowering said carriage by deflecting said wheels.

13. The scraper as defined in claim 11 wherein:

said carriage comprises a rigid, box-like frame having a floor, a front adapted to be coupled to a tow vehicle, a rear supported by wheels, and a pair of opposed sides, said floor, rear and sides defining said interior;

said scraper is transversely disposed across said aperture and extends generally between said sides; and, said ejector comprises a rigid, generally rectangular plate extending transversely within said hopper generally between said sides and displaceable between said front and said rear and, said scraper comprises a hydraulic actuator for controlling said ejector.

14. The scraper as defined in claim 11 wherein said scissor means comprises:

a first rigid, elongated lever comprising a rear end pivotally coupled to said carriage, a middle, and a front end coupled to an end of said ejector;

a second rigid, elongated lever comprising a rear end pivotally coupled to said carriage, a middle, and a front end coupled to said ejector; and, wherein said first and second levers intersect one another to form an X-shaped profile.

15. The scraper as defined in claim 14 further comprising pivot means extending through the middle of both levers for interconnecting with cylinder means associated with said ejector.

16. The scraper as defined in claim 15 wherein at least one end of each of said elongated levers comprises a follower received within a follower slot for dimensionally compensating as said scissor means retracts or deploys.

17. A high performance ejector-scraper comprising;

a rigid carriage adapted to be moved over terrain with a rough topography to be treated, said carriage having a front and a rear;

wheel means for supporting the carriage, said wheel means comprising two or more pairs of spaced apart and offset wheels emanating from the rear of said carriage, each pair of wheels comprising:

an elongated, rigid carrier pivotally coupled to said carriage;

a rocker controlled by said carrier, the rocker comprising opposed, front and rear ends;

a first axle extending transversely outwardly from the rocker front end;

a second axle extending transversely outwardly an opposite direction from said first axle, said second axle extending from the rocker rear end;

whereby, said wheel pairs pivot about said rocker in response to changes in the rough terrain topography;

a hopper disposed within said carriage, said hopper having a front, a back, a pair of opposed sides separated by the width of the hopper, and an interior;

an aperture defined in the hopper for admitting or discharging earth;

a gate for opening or closing said aperture;

power means for opening or closing said gate;

a scraper mounted beneath the hopper for engaging earth when the gate is opened; an ejector for discharging the contents of said hopper through said aperture to empty said scraper;

alignment means for maintaining even longitudinal displacement of said ejector; and, means for deploying and withdrawing said ejector.

18. The scraper as defined in claim 17 wherein said rocker is linked to said carrier by a generally V-shaped link pivotally coupled at one end to said carrier and pivotally coupled at the other end to said rocker.

19. The scraper as defined in claim 17 wherein said means for deploying and withdrawing said ejector comprises a scissor system, and said alignment means comprises two or more spaced apart rails securely attached within the interior of said hopper; and corresponding flanged wheels attached to said ejector engage said rails to allow longitudinal displacement of said ejector while prohibiting transverse movement of said ejector.

20. A high performance ejector-scraper comprising;

a rigid carriage adapted to be displaced over ground to be worked;

a wheel system for suspending said carriage upon said ground, said wheel system comprising two pairs of spaced apart and offset wheels that engage the ground and suspension means for elevating or lowering said carriage by deflecting said wheels;

a hopper disposed within said carriage having a storage interior and an input-output aperture that can be opened or closed;

a scraper exposed when said aperture is open for selectively engaging earth;

a retractable gate for opening said hopper to expose said aperture for filling said interior with earth dislodged by said scraper;

an ejector for selectively emptying said hopper through said aperture;

scissor means for pushing or pulling said ejector; and, cylinder means for deflecting or retracting said scissor means.

21. The scraper as defined in claim 20 wherein said scissor means comprises:

a first rigid, elongated lever comprising a rear end pivotally coupled to said carriage, a middle, and a front end coupled to an end of said ejector; and, a second rigid, elongated lever comprising a rear end pivotally coupled to said carriage, a middle, and a front end coupled to said ejector.

22. The scraper as defined in claim 21 wherein: said first and second levers intersect one another to form an X-shaped profile, and at least one end of each of said elongated levers comprises a follower received within a follower slot for dimensionally compensating as said scissor means retracts or deploys.

* * * * *